US011891886B2

(12) United States Patent
Kuzyaev

(10) Patent No.: US 11,891,886 B2
(45) Date of Patent: Feb. 6, 2024

(54) METHOD FOR SELECTIVE TREATMENT OF A PRODUCING FORMATION, DEVICE FOR THE IMPLEMENTATION THEREOF AND HYDRAULIC FRACTURING PORT

(71) Applicant: Salavat Anatolyevich Kuzyaev, Yekaterinburg (RU)

(72) Inventor: Salavat Anatolyevich Kuzyaev, Yekaterinburg (RU)

( * ) Notice: Subject to any disclaimer, the term of this patent is extended or adjusted under 35 U.S.C. 154(b) by 66 days.

(21) Appl. No.: 17/439,206

(22) PCT Filed: Oct. 15, 2020

(86) PCT No.: PCT/RU2020/000540

§ 371 (c)(1),
(2) Date: Sep. 14, 2021

(87) PCT Pub. No.: WO2021/086230

PCT Pub. Date: May 6, 2021

(65) Prior Publication Data

US 2022/0259961 A1 Aug. 18, 2022

(30) Foreign Application Priority Data

Nov. 1, 2019 (RU) ..... 2019135222

(51) Int. Cl.
*E21B 43/26* (2006.01)
*E21B 43/119* (2006.01)

(52) U.S. Cl.
CPC ..... *E21B 43/261* (2013.01); *E21B 43/119* (2013.01)

(58) Field of Classification Search
CPC ... E21B 43/261; E21B 43/119; E21B 43/1193
See application file for complete search history.

(56) References Cited

U.S. PATENT DOCUMENTS 9,284,823 B2 3/2016 Kratochvil et al.
2004/0055749 A1* 3/2004 Lonnes ..... E21B 43/25 166/373

(Continued)

FOREIGN PATENT DOCUMENTS

RU 2162514 1/2001
RU 2547892 4/2015

(Continued)

*Primary Examiner* — Shane Bomar
(74) *Attorney, Agent, or Firm* — Aleksandr Smushkovich

(57) ABSTRACT

The proposed technology relates to methods and devices for selective treatment of wellbores that allows treating several intervals of a productive formation in a single trip. The proposed device for implementing the method includes a mechanical anchor, hydraulic fracturing port, packers and a perforator disposed in the device's bottom part. It is lowered into a well casing to the depth of productive formation. Working fluid is supplied to the perforator via a tubing string, the well casing is perforated, and caverns are washed out. The device is positioned so that the perforation interval is situated between the packers, fixed in the well casing by the anchor, and working fluid is then cut off. Hydraulic fracturing fluid is supplied, and the productive formation's interval is isolated from the well casing's annulus by activation of the packers. Hydraulic fracturing is executed, and the device is removed from the well casing.

10 Claims, 6 Drawing Sheets

(56) References Cited

U.S. PATENT DOCUMENTS

Figure 1:
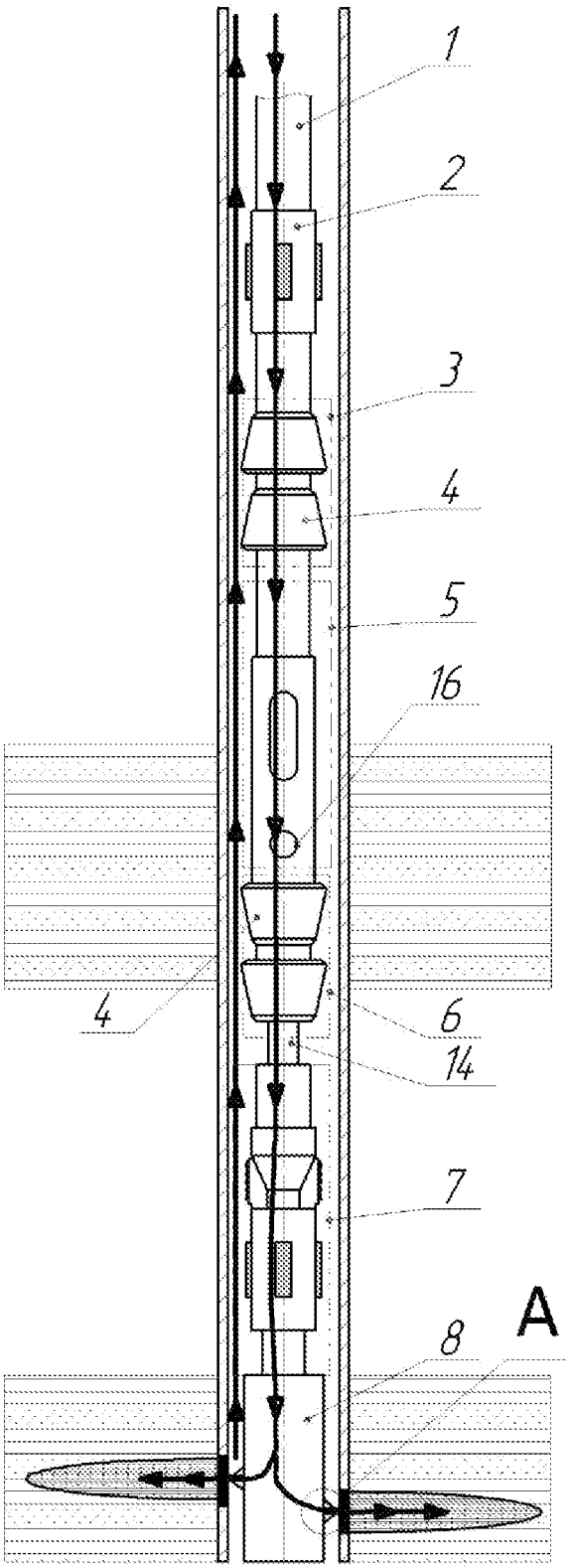

| | | | | |
|---|---|---|---|---|
| 2007/0151735 | A1* | 7/2007 | Ravensbergen | E21B 17/206 166/308.1 |
| 2008/0296019 | A1* | 12/2008 | Johnson | E21B 43/04 166/278 |
| 2012/0055671 | A1* | 3/2012 | Stromquist | E21B 23/006 166/387 |
| 2014/0041876 | A1* | 2/2014 | Fleckenstein | E21B 43/14 166/329 |
| 2015/0013982 | A1* | 1/2015 | Getzlaf | E21B 34/14 166/316 |
| 2018/0216446 | A1* | 8/2018 | Allison | E21B 43/26 |
| 2021/0148179 | A1* | 5/2021 | Petrella | E21B 33/1277 |
| 2023/0003106 | A1* | 1/2023 | Conzemius | E21B 43/119 |
| 2023/0332485 | A1* | 10/2023 | Kuzyaev | E21B 33/126 |

FOREIGN PATENT DOCUMENTS

| | | |
|---|---|---|
| RU | 2555989 | 7/2015 |
| RU | 2601881 | 11/2016 |
| RU | 2618545 | 5/2017 |
| RU | 185859 U1 | 12/2018 |

* cited by examiner

B-B

METHOD FOR SELECTIVE TREATMENT OF A PRODUCING FORMATION, DEVICE FOR THE IMPLEMENTATION THEREOF AND HYDRAULIC FRACTURING PORT

CROSS-REFERENCE TO RELATED APPLICATIONS

This application is a U.S. national stage application of an international application PCT/RU2020/000540 filed on 15 Oct. 2020, published as WO2021086230, which international application claims priority of a Russian Federation patent application RU2019135222 filed on 1 Nov. 2019.

FIELD OF THE INVENTION

The invention is designed for mining, namely: methods and devices for selective processing of wells of various designs, and in case of need for repeated wells processing when using selective technology for processing a productive formation.

BACKGROUND OF THE INVENTION

A device and method for performing multi-stage hydraulic fracturing in one lifting operation are known, presented in Russian Federation utility model patent No. 185859 (published 20 Dec. 2018, bulletin 35).

The device for carrying out multistage hydraulic fracturing consists of tubing string (hereinafter tubing), upper and lower selective packers, frac port with hole for frac slurry injection (hereinafter fracking), perforated pipe of tubing string, shut-off valve and the perforating device.

The device for multi-stage hydraulic fracturing goes into a well with several productive formations, the perforating device is adjusted to lower interval of fracking, the fluid is pumped through the tubing string, which, coming from the frac port through the hole for pumping hydraulic fracturing fluid reservoir, activates upper and lower selective packers. When the pressure in the tubing string increases, the pressure in the inter-packer space increases, too. The fluid, passing through the holes of the perforated branch pipe, enters the straight way bore of the lower selective packer and is supplied to perforating device through bores of pressure shut-off valve.

The perforating device presented in the patent description contains a housing into which a piston with a punch is inserted. Under the pressure, the fluid drives a piston with a punch that perforates a casing pipe. Pressure in the tubing string is relieved and the upper and lower selective packers are brought to the transport position. Packaging arrangement is lowered so that the inter-packer space is located opposite the perforated interval of the hydraulic fracturing. Gradually increasing the pressure in the tubing string, the upper and lower selective packers are activated. At the moment when pressure in shut-off valve equals a value P1 (where P1—pressure shut-off valve actuating pressure), bores are overlapped to avoid transmitting a pressure exceeding P1 value to the perforating device. After activation of pressure shut-off valve, scheduled hydraulic fracturing (injection of fluid and propping agent) is performed in this interval. After the end of this stage of hydraulic fracturing, the pressure in the tubing string is relieved, the packers are transferred to the transport position, and the packaging arrangement is re-adjusted to the next higher interval of hydraulic fracturing.

When describing an example of device application, it is indicated that during perforation, perforating device is activated at a pressure of 200 atm. Subsequent increase in pressure to activate the shut-off valve takes place before reaching 220 atm.

In this case, the perforating device is located outside of productive formation processing interval and, being activated at a pressure greater than the perforation pressure, can pierce the column outside the processed intervals, which leads to damage to the casing and depressurization.

In addition, the consequence of low manufacturability and reliability of the device is lack of its reliable fixation with activated selective packers, especially during hydraulic fracturing. High pressure delivery can lead to linear lengthening of the tubing, vibration and premature damage to gaskets of cup packers, which are pressed with force against the walls of the production column.

Disadvantage of hydraulic fracturing is low manufacturability, impossibility of cavern washout, especially in wells, design of which involves cementing of casing columns, where perforation by a perforating device may not be sufficient to ensure hydraulic connection of the well with a productive formation.

In addition, perforation is performed with activated packers, which prevents circulation of fluid through the annulus, so caverns washout is impossible.

The closest analogues to the presented technical solutions are method and variants of the device presented in U.S. Pat. No. 9,284,823 (publ. 15 Mar. 2016) "Combined perforating tool". Well-known combined tool is designed for perforation of waterlogged wells and hydraulic fracturing in one tripping process for development of several productive formations. The known device includes a hydraulic fracturing port, a drive mechanism of a boring machine with a reinforcing node, a boring machine and cup packers. At the lower end of a flexible tubing, a lower cup packer is installed, while its expanding end is directed into the well and prevents leakage of fluid of the watered well up between the casing string and the device. Above, a bypass mechanism is installed to bypass the borehole fluid around the device, consisting of a sliding housing with spring elements that engage with the inner part of the borehole. When lower packer is activated and spring elements of the housing of the bypass mechanism that prevents moving the downhole fluid in the annular space (generally known as a space between the outer surface of the device/tubing sting and, on the other hand, the inner surface of the well casing) during movement of the tool up is fixed, held sliding body opens a hole through which fluid of the flooded well penetrates into the annular space and moves up to bypass the activated packer. After that a perforating boring machine, its drive mechanism with a reinforcing node, the upper cup packers with expanding ends, which are directed to the hydraulic fracturing port installed on top, is installed up coiled tubing. A valve assembly is installed between the upper cup packer and the hydraulic fracturing port, which cuts off fluid to the boring machine during hydraulic fracturing.

The known method of perforation of well casing string and subsequent hydraulic fracturing includes lowering of the tool into the well, the flow of the working fluid for actuating the drive mechanism of the punch, perforation of the casing string, moving the device down the bore to match the port of fracture with a perforated area of the casing, activating the upper cup packer to isolate the bottom of fracturing port and to activate the valve unit in order to disable the drive mechanism of the punch, fluid flow into the fracture port and fracturing.

Disadvantage of hydraulic fracturing is low manufacturability, impossibility of cavern washout, especially in wells, design of which involves cementing of casing columns, where perforation by a perforating device may not be sufficient to ensure hydraulic connection of the well with a productive formation.

The known device is equipped with only one packer, the cup elements of which are directed from the hydraulic fracturing port and installed below the hydraulic fracturing port and below the interval of the productive insulation formation. This is its disadvantage, since the hydraulic fracturing fluid under pressure can penetrate not only into the productive formation, but also spread up through annulus, which can damage the production string and result in device sticking.

OBJECTIVES AND SUMMARY OF THE INVENTION

The objective of the presented technical solutions is to create an effective method for safe selective processing of a productive formation with the ability to process multiple intervals of a productive formation in one tripping process using a simple and reliable device.

The technical result is that the inventive technology of processing a productive formation includes perforation with the possibility of caverns washout and hydraulic fracturing with complete isolation of each interval of the formation.

The technical result is that the inventive technology also includes separation of the hydraulic fracturing interval, which is provided on both sides with a reliable fixation of the device in a well casing and that the control of all technological operations is provided by a simple device.

The technical result is achieved by the proposed method of selective processing of the formation, including lowering a device fitted with a mechanical anchor, fracturing port, frac packers, a perforator installed in the lower part of the device into a well casing to a depth corresponding to the productive formation and connecting device to the specified interval of the productive formation. Then working fluid is supplied under pressure through a tubing string 1 to the perforator, the well casing is perforated and a subsequent washout of the caverns is carried out. After that, the perforator is brought to the transport position. Then, the device shall be installed so that the perforation interval is situated between the packers, fixed in the well casing, and access of the working fluid to the perforator should be blocked. After that hydraulic fracturing fluid is supplied under pressure, the packers are activated to separate the interval of the productive formation from an annulus and perform hydraulic fracturing. After that, reducing the pressure in the inter-packer space, the device is brought to the transport position and removed from the well casing. An annulus (or an annular space) is herein defined as a space between the outer surface of the device and the inner sidewall surface of the well casing, vertically limited by level positions of the upper packer and the lower packer.

The device, equipped with the mechanical anchor, the hydraulic fracturing port, the packers and the perforator, is lowered into the well casing to a depth corresponding to the lowest interval of the productive formation.

In multiple intervals, the processing is carried out during one tripping process.

Binding of the device to a given interval of the productive formation can be carried out by a mechanical locator of couplings. If necessary, after hydraulic fracturing, the inter-packer space is washed.

The technical result is also achieved by the fact that the device for implementing the method of selective processing of the productive formation has a perforator, a mechanical anchor, upper and lower straight way packers and a hydraulic fracturing port installed on the tubing string. Innovation is that the hydraulic fracturing port is connected to the lower straight way packer and connected to the hollow rod. The hollow rod is rigidly connected to the anchor connected to the perforator and provides for hydraulic connection of the tubing string with the perforator.

The perforator is equipped with perforating elements with hydraulic monitoring holes.

The upper and lower packers are straight way. Elastic elements of the packers can be cup-shaped, opening in the direction of the hydraulic fracturing port, with the upper packer installed above the hydraulic fracturing port.

The hollow rod is made with a base that overlaps its cavity from above, and is provided with protrusions for coupling with the hydraulic fracturing port. In addition, the hollow rod has radial holes located under its base, through which hydraulic communication with the inner cavity of the tubing string is carried out.

The hydraulic fracturing port is provided with a hollow body with holes for hydraulic fracturing and a liner (also called 'bushing') connected to the hollow body with the possibility of axial movement. The inner surface of the housing is provided with a bore back to provide hydraulic connection with the holes of the hollow rod. The liner is provided with windows for hydraulic fracturing, while holes are made in the liner for coupling with the hollow rod of the device. A housing of the hydraulic fracturing port includes longitudinal radial holes, designed for axial movement of the rod protrusions and to prevent rotation of the rod.

Use of the perforator with hydraulic monitoring holes in the device allows for perforation of the well casing with a simultaneous washout of the caverns, providing for a reliable hydraulic connection with the productive formation, which creates conditions for high-quality hydraulic fracturing.

Presence of the mechanical anchor in the device, rigidly connected to the perforator and the hollow rod, provides for stability against vibration during hydraulic fracturing.

Design of the hydraulic fracturing port, interconnection of the anchor and the perforator, made it possible to use the straight way packers with the elastic elements that provide for reliable isolation of the annulus and efficient hydraulic fracturing.

Simple and reliable design of the device provides the possibility of trouble-free processing of one or more intervals of the productive formation in one tripping process.

DESCRIPTION OF DRAWINGS OF THE INVENTION

FIG. 1 demonstrates general view of a device for selective processing of a productive formation, when performing perforation and caverns washout.

Figure 2:
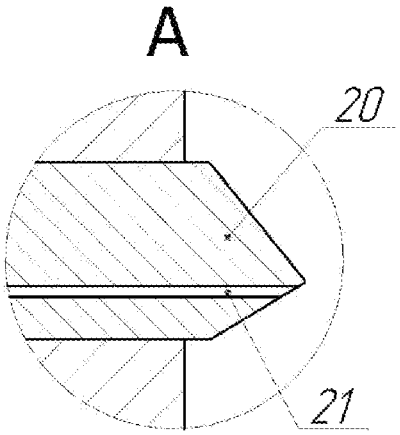

FIG. 2 demonstrates an enlarged view of the destructive elements and hydraulic monitoring holes of the perforator.

Figure 3:
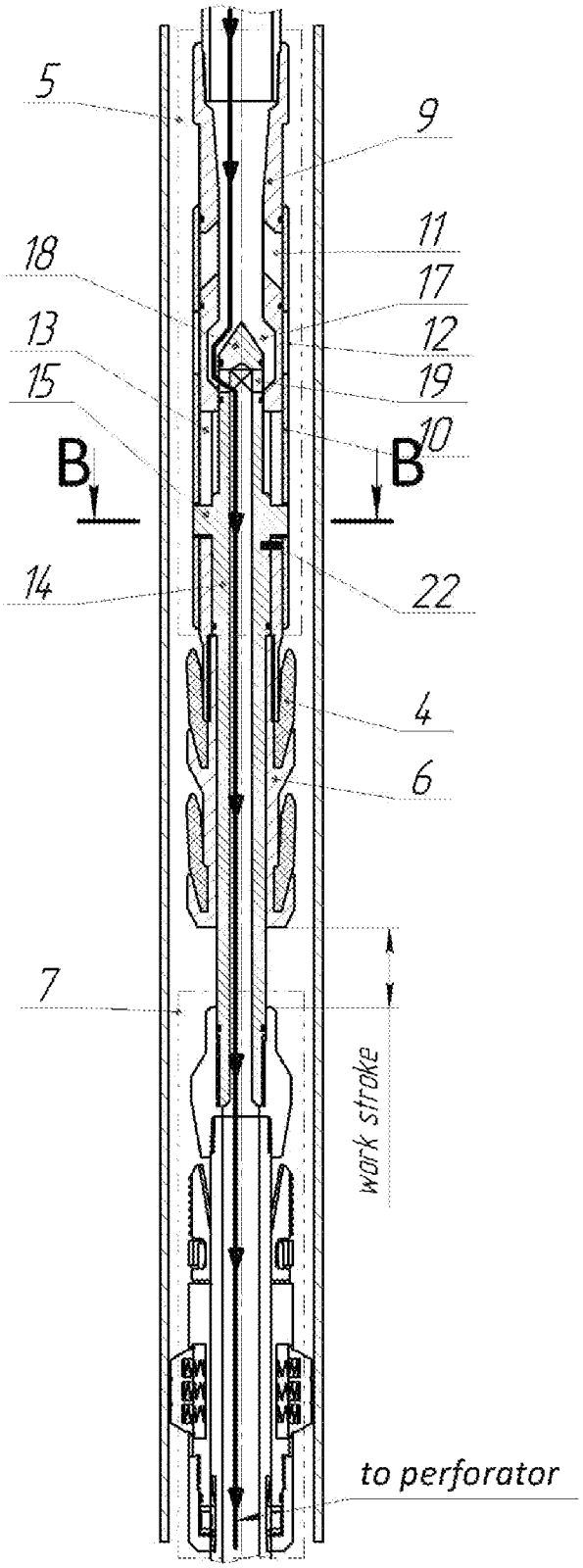

FIG. 3 demonstrates an axial section of the main units of the device as part of the hydraulic fracturing port, lower packer and an anchor in the perforation position.

Figure 4:
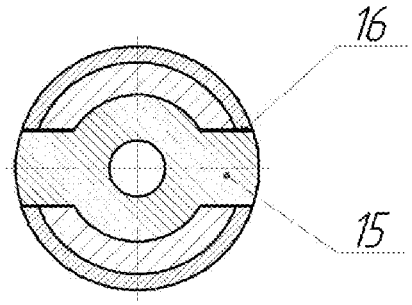

FIG. 4 demonstrates a B-B section of the device shown in FIG. 3.

Figure 5:
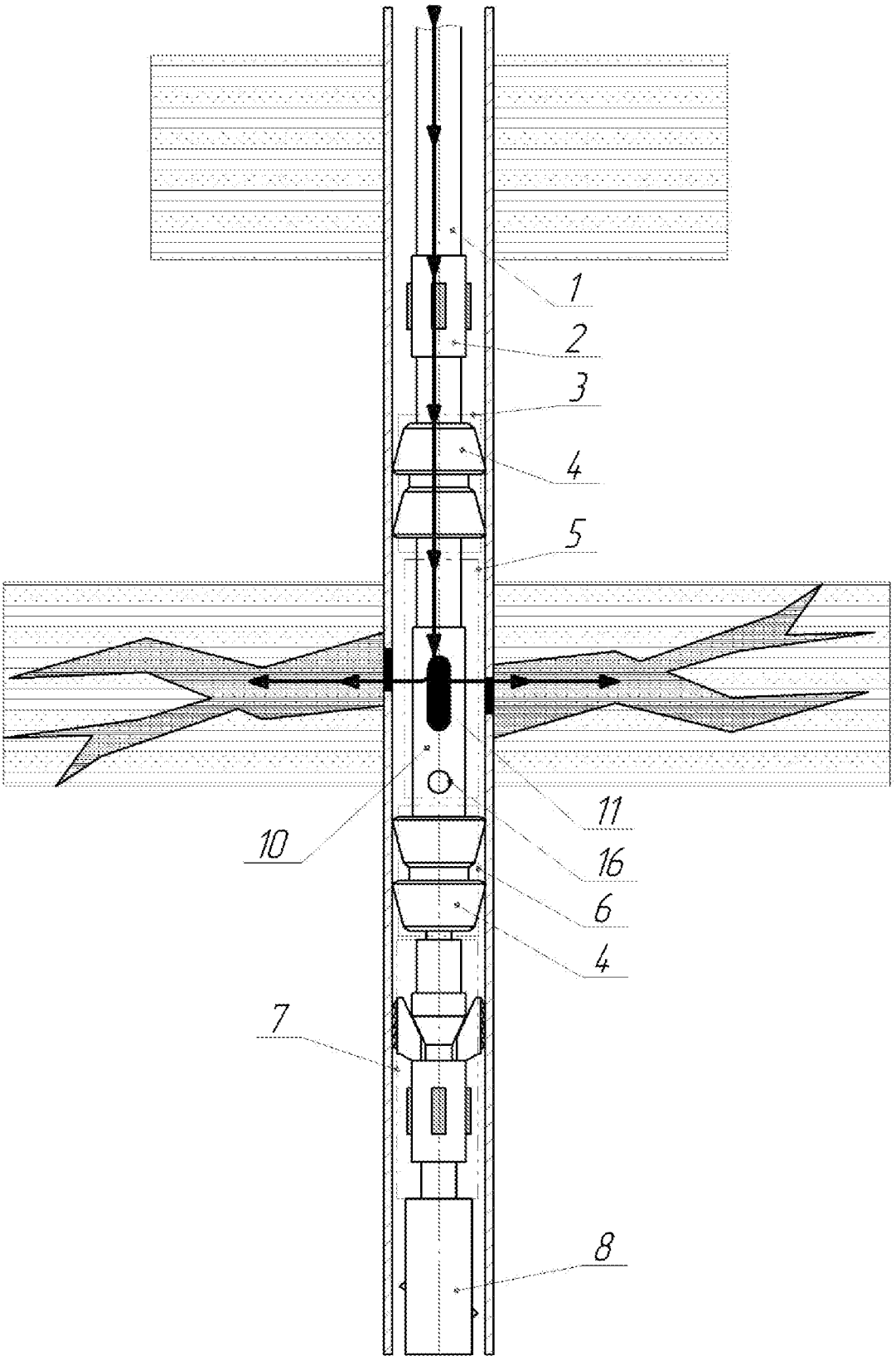

FIG. 5 shows a general view of the device during hydraulic fracturing.

Figure 6:
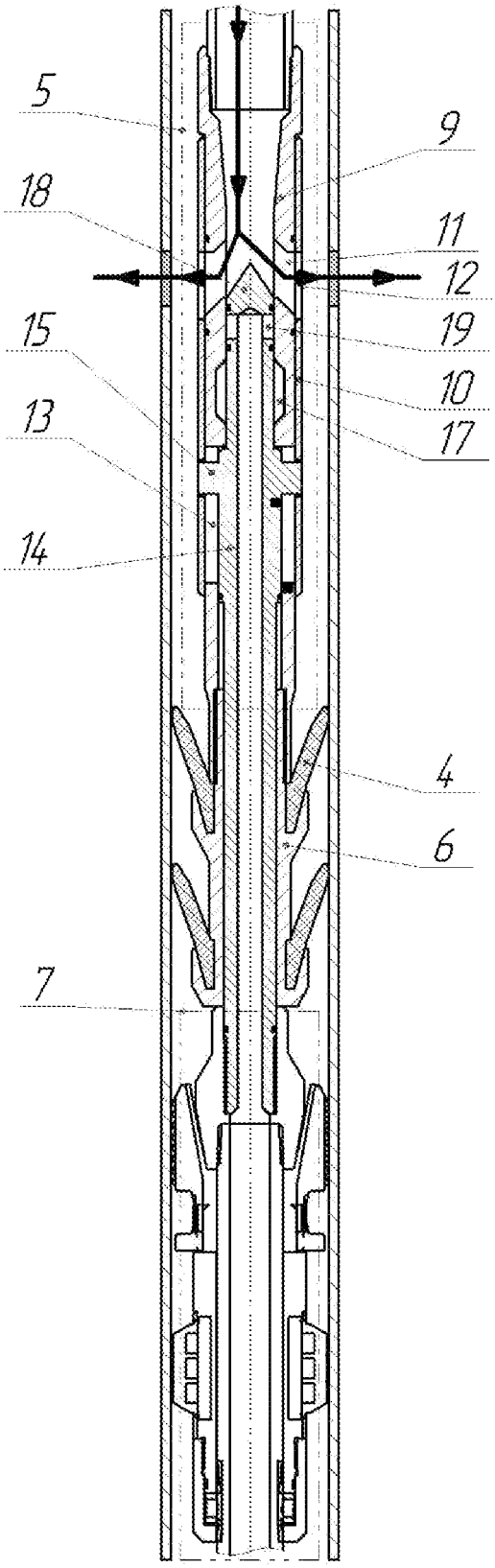

FIG. 6 demonstrates an axial section of the main units of the device as part of the hydraulic fracturing port, lower packer and an anchor in the hydraulic fracturing position.

DESCRIPTION OF PREFERRED EMBODIMENTS OF THE INVENTION

The device comprises a tubing string 1 (FIG. 1, FIG. 2) and mounted (from top to bottom) on the tubing string 1: a mechanical collar locator 2, an upper straight way packer 3 with two cup sealing elements 4, a hydraulic fracturing port 5, a lower straight way packer 6, a straight way mechanical anchor 7 and a perforator 8.

The device can have a mechanical collar locator A 1025-2, e.g. the one presented in the catalog "Tools for current and major repairs of wells", p. 31 <https://www.slb.ru/upload/iblock/d8e/katalog-instrumentov-dla-tekushego-i-kapitalnogo-remonta-skvajin.pdf)>.

The hydraulic fracturing port 5 includes: a hollow cylindrical housing 9 rigidly connected to the lower straight way packer 6, and a liner 10 installed with the possibility of axial movement. The housing 9 contains hydraulic fracturing holes 11, closed in a transport position by the liner 10, which includes hydraulic fracturing windows 12. In addition, the housing 9 includes longitudinal radial holes 13 designed for axial movement of protrusions 15 of a hollow rod 14 and to prevent rotation of the hollow rod 14.

Inside the hydraulic fracturing port 5, with the possibility of axial and synchronous movement with the liner 10, the hollow rod 14 is installed, on the side surface of which radial protrusions 15 are made. The liner 10 is provided with the hydraulic fracturing windows 12 and with holes 16, with which the protrusions 15 of the hollow shock 14 couple. Inner surface of the housing 9 is provided with a bore back 17.

The hollow rod 14 is made with a base 18 overlapping it from above, and with radial holes 19 located under the base 18. Hydraulic communication of the tubing string 1 with the perforator 8 is carried out through the bore back 17 and open holes 19 of the hollow rod 14, rigidly connected to the mechanical anchor 7. The hydraulic fracturing port 5 is connected to the lower straight way packer 6.

The perforator 8 is equipped with destructive elements 20 with hydraulic monitoring holes 21 and is connected to the mechanical anchor 7.

In transport position, during the lowering of the device into the well casing, the hollow rod 14 is prevented from the axial reciprocating motion by the destructible element 22.

Principles of the Device Operation

Before lowering into the well casing, the device is assembled at the wellhead, and is mounted on the tubing string 1; specifically, the following parts are installed from the bottom up: the perforator 8, the straight way mechanical anchor 7, the lower straight way packer 6, the hydraulic fracturing port 5, the upper straight way packer 3, and the mechanical locator 2 of couplings.

When the device is lowered into the well casing, the perforator 8, the upper 5 and lower 6 straight way packers are set in the transport position, the hollow rod 14 is situated in the lower position and fixed from axial movement by the destructible element 22. The liner 10 is situated in the lower position and covers the hydraulic fracturing holes 11 of the housing 9. In addition, the protrusions 15 of the hollow rod 14 are coupled with the holes 16 of the liner 10. The radial holes 19 of the hollow rod 14, through which the hydraulic connection of the cavity of the tubing string 1 is provided with the cavity formed by the bore back 17 and the base 18 of the hollow rod 14, and through the straight way mechanical anchor 7 with the perforator 8, are open (FIG. 1).

If it is necessary to process several intervals, the device is lowered so that the perforator 8 is positioned at the level of the lowest interval of the productive formation to be processed. After that, the pump unit located on the surface supplies working fluid under pressure into the tubing string 1. Working fluid, passing through the inner cavity of the tubing string 1 and the straight way units of the device, enters the perforator 8 and impacts on the destructive elements 20, which perforate the well casing, while caverns formed during the perforation are simultaneously washed out through the hydraulic monitoring holes 21.

At the same time, working fluid, leaving the hydro monitoring holes, is reflected from the walls of the cavity and flows into the annulus, rises to the surface, carrying out free circulation in a closed circuit.

After the perforation is completed, the supply of working fluid under pressure is stopped and the device is moved in the well casing so that the perforated interval is situated between the upper 3 and lower 6 straight way packers, and the device is fixed in the well casing with the mechanical anchor 7. Thus, the hollow rod 14, which is rigidly connected to the mechanical anchor 7, is stationary. In addition, the liner 10 remains stationary, the holes 16 of which are engaged with the protrusions 15 of the hollow rod 14.

When unloading with the mechanical anchor 7 under the weight of the tubing string 1, the destructible element 22 is cut off and the housing 9 of the hydraulic fracturing port 5 along with the straight way packers 3 and 6 are moved downwards by the stroke H (FIG. 3). The radial holes 19 are covered by the housing 5, blocking the hydraulic connection of the inner cavity of the tubing string 1, with the straight way anchor 7 and the perforator 8, protecting them from the pressure of working fluid and hydraulic fracturing fluid. In addition, when the housing 9 of the hydraulic fracturing port 5 is moving down by the stroke, the hydraulic fracturing holes of the housings 9 and the window 12 of the liner 10 are aligned, thereby providing for a hydraulic connection of the internal cavity of the tubing string 1 with inter-packer space and the productive formation.

Further, hydraulic fracturing fluid is supplied to the tubing string 1 and, thanks to the counter flow from the port 5, the cup sealing elements 4 of the straight way packers 3 and 6 are opened and hermetically attached to the inner wall of the well casing, insulating the inter-packer space. After that, hydraulic fracturing is performed and the pressure in the well casing is released.

If it is necessary to process several intervals of the productive formation, the device is moved in the direction of the wellhead to the next interval and the method of selective processing is repeated in the above sequence of actions.

The method of selective processing of a productive formation is carried out as follows. The device is lowered into the well casing with a length of 3,550 m with a well casing with a diameter of 102 mm and a thickness of 6.5 mm (strength group "D" according to GOST 632) and its binding to a given interval of the productive formation is carried out using the mechanical collar locator, for example, A 1025-2 (catalog "Schlumberger" <https://www.slb.ru/upload/iblock/d8e/katalog-instrumentov-dla-tekushego-i-kapitalnogoremonta-skvajin.pdf) p.31>).

Three intervals were determined as a result of studies of the productive formation, that need to be processed: the lowest interval located between 3,520-3,510 m, the next one located between 3,455-3,440 m and the highest interval located between 3,393-3,383 m.

Due to the fact that the lowest interval of the productive formation is processed first, the device is lowered until the perforator 8 is at the level of the interval located between 3,520-3,510 m.

After fitting the perforator to the lower boundary of the first processed interval, the working fluid is supplied at a pressure of 200 atm. into the inner cavity of the tubing string 1. Working fluid is supplied through hydraulic fracturing port 5 and mechanical anchor 7 to the perforator 8, the liner 10 overlaps the hydraulic fracturing hole 11 of the housing 9 of the port 5, sealing and separating the annular space from the inner cavities of the device.

Under the working fluid, the destructive elements 20 of the perforator 8 form holes in the well casing, through which, during the technological time (up to 15 minutes), the caverns are washed through the hydraulic monitoring holes 21.

When caverns are washed, the working fluid is supplied from the surface through the inner cavity of the tubing string 1 to the hydraulic fracturing port, mechanical anchor and perforator, and flows out through the hydraulic monitoring holes, washing the caverns. Working fluid from the processed productive formation penetrates into the free annular space, rises from the well casing to the surface, circulating in a closed circuit (FIG. 1). Perforation of the well casing and washout of the caverns are carried out based on the density of ten holes per one meter of the length of the well casing. Formation of the holes in the treated interval is carried out sequentially in the direction of the wellhead.

Upon completion of the perforation and caverns washout, the device is lowered until the perforation interval is positioned between the upper 3 and lower 6 packers, and the device is fixed in the well casing, activating the mechanical anchor 7.

When the anchor 7 is activated, the element 22 is destroyed by the weight of the tubing string 1 (up to 4 tons), while the hydraulic fracturing port 5 and the lower straight way packer 6 are moved till landing on the mechanical anchor 7. The housing 9 of the port 5 moves relative to the hollow rod 14, the hydraulic fracturing holes 11 and hydraulic fracturing windows 12 of the liner 10 are combined, connecting the internal cavity of the tubing string 1 with the inter-packer annular space.

After that, with a gradual increase in pressure, the hydraulic fracturing fluid is fed into the inner cavity of the tubing string 1 and activates the upper 3 and lower 6 packers. When the process pressure is reached, depending on the characteristics of the rock (up to 1,000 atm. in dense rock deep bedding), through the aligned holes of the housing 9 of the port 5 and the windows of the liner 10, fracturing fluid is pumped into the perforated interval of the productive formation (FIG. 6).

If after the hydraulic fracturing, performed in accordance with the production plan, the inter-packer space and cavities of the device contain remains of the fracturing fluid, pressure relief of the inter-packer space tales place to bring the packers into the transportation position and wash the wells through the hydraulic fracturing holes 11 using working fluid supply to the annulus.

In order to process the next interval of 3,455-3,440 m of the productive formation, the device is transferred to the transport position through deactivating the anchor 7. After that, the device is moved up to overlap the holes of the hydraulic fracturing housing 9 of the hydraulic fracturing port 5. In this case, the inner cavity of the tubing string 1 is combined through the holes 21 with the cavity of the rod 14, providing a hydraulic connection with the perforator 8.

The device in the transport position is moved up to the next interval of the productive formation to be treated.

The invention claimed is:

1. A method for selective processing of a number of intervals of a productive formation, comprising the steps of: providing a borehole associated with the productive formation; providing a well casing within the borehole; providing a tubing string inserted into the well casing; said tubing string defines a string external surface; providing a device essentially coupled with the tubing string; said device defines a device external surface; the string external surface and the device external surface together form a common external surface; wherein an annulus is defined as a space between the common external surface and the well casing; said device includes: an upper packer and a lower packer defining an inter-packer space therebetween; a hydraulic fracturing port located in the inter-packer space; a mechanical anchor located below the lower packer; and a perforator being in controllable hydraulic communication with the tubing string, and located below the mechanical anchor; lowering said device into the well casing to a depth corresponding to the productive formation; positioning said device at a predetermined interval chosen from said number of intervals; supplying pressurized working fluid through the tubing string to the perforator; carrying out a perforation of the well casing by the perforator, by punching sidewalls of the well casing and creating caverns in sidewalls of the borehole within the predetermined interval; providing washing out of the caverns; bringing the perforator into a transportation position; positioning said device so that the predetermined interval is located between the upper packer and the lower packer; fixing said device in the well casing using the mechanical anchor; blocking access of the working fluid to the perforator; supplying fracturing fluid under pressure into the tubing string and into the inter-packer space; activating the upper packer and the lower packer thereby providing separation of the predetermined interval from the annulus; providing hydraulic fracturing of the productive formation by the fracturing fluid; reducing a pressure of the fracturing fluid in the inter-packer space; transferring said device into the transportation position; and removing said device from the well casing.

2. The method for selective processing according to claim 1, wherein said predetermined interval is a lowest interval chosen from said number of intervals.

3. The method for selective processing according to claim 1, wherein said device further includes a mechanical collar locator mounted above the upper packer, wherein said mechanical collar locator provides said positioning of the device in relation to the predetermined interval.

4. The method for selective processing according to claim 1, wherein, if said number of intervals is greater than one, said method is carried out, for each said predetermined interval chosen from the number of intervals in one tripping.

5. The method for selective processing according to claim 1, further comprising a step of washing out the inter-packer space after the step of providing hydraulic fracturing of the productive formation.

6. A device mounted on a tubing string inserted into a well casing; said tubing string defines a string external surface; said device defines a device external surface; the string external surface and the device external surface together form a common external surface; wherein an annulus is defined as a space between the common external surface and the well casing; said device includes: an upper packer and a lower packer defining an inter-packer space therebetween; a mechanical anchor located below the lower packer; a perforator being in controllable hydraulic communication with the tubing string, and located below the mechanical anchor; and a hydraulic fracturing port, connected with the lower packer and with a hollow rod rigidly coupled to the mechanical anchor, thereby providing for hydraulic communication of the tubing string with the perforator; wherein the hollow rod further includes a cavity, a base overlapping the cavity from above, and is equipped with protrusions provided for coupling the hollow rod with said hydraulic fracturing port; wherein the tubing string further includes an inner cavity; and wherein the hollow rod is further equipped with radial holes located under said base, providing for hydraulic communication of the hollow rod with the inner cavity.

7. The device according to claim 6, wherein: the hollow rod is further equipped with protrusions and radial holes; the hydraulic fracturing port is further equipped with: a hollow housing and fracturing holes, said hollow housing defines an outer surface and an inner surface thereof, and said hollow housing is furnished with radial longitudinal holes providing for axial movement of the protrusions of said hollow rod to prevent rotation thereof; and a liner, mounted on the outer surface of said hollow housing, and capable of axial movement thereon; wherein: the inner surface of said hollow housing is furnished with an annular cavity, providing for hydraulic communication with the radial holes of said hollow rod; the liner is provided with a number of windows for hydraulic fracturing; and the liner is provided with holes for coupling thereof with the protrusions of said hollow rod.

8. The device according to claim 6, wherein the perforator is equipped with perforating elements provided with hydraulic monitoring holes.

9. The device according to claim 6, wherein the upper packer and the lower packer are equipped with elastic elements having a cup shape opened in a direction of the hydraulic fracturing port.

10. The device according to claim 6, wherein the upper packer is located above the hydraulic fracturing port.

* * * * *